US008259014B2

(12) United States Patent
Wu

(10) Patent No.: US 8,259,014 B2
(45) Date of Patent: Sep. 4, 2012

(54) MULTI-LOOP ANTENNA STRUCTURE AND HAND-HELD ELECTRONIC DEVICE USING THE SAME

(75) Inventor: Wei-Yang Wu, Taoyuan (TW)

(73) Assignee: HTC Corporation, Taoyuan County (TW)

( * ) Notice: Subject to any disclaimer, the term of this patent is extended or adjusted under 35 U.S.C. 154(b) by 489 days.

(21) Appl. No.: 12/634,704

(22) Filed: Dec. 10, 2009

(65) Prior Publication Data

US 2010/0271271 A1 Oct. 28, 2010

(30) Foreign Application Priority Data

Apr. 27, 2009 (TW) ..... 98113943 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 7,345,637 B2 * 3/2008 Mizoguchi et al. ..... 343/702
2005/0270238 A1 * 12/2005 Jo et al. ..... 343/702
2007/0115200 A1 5/2007 Ishimiya
2008/0169981 A1 7/2008 Hotta et al.
2009/0289869 A1 * 11/2009 Babakhani et al. ..... 343/850

FOREIGN PATENT DOCUMENTS

EP 1555-715 A1 7/2005
JP 2007/088975 A 4/2007

* cited by examiner

*Primary Examiner* — Dieu H Duong
(74) *Attorney, Agent, or Firm* — Rabin & Berdo, P.C.

(57) ABSTRACT

A multi-loop antenna structure and a hand-held electronic device using the same are provided. The multi-loop antenna structure includes a high-frequency radiating body, a low-frequency radiating body, a feeding connecting part and a grounding connecting part. The feeding connecting part electrically connects one terminal of the high-frequency and the low-frequency radiating body to a feeding point. The grounding connecting part grounds the other terminal of the high-frequency and the low-frequency radiating body. The feeding connecting part forms a first folded loop antenna with the high-frequency radiating body and the grounding connecting part for resonating at a first frequency band. The feeding connecting part forms a second folded loop antenna with the low-frequency radiating body and the grounding connecting part for resonating at a second, a third and a fourth frequency band. The first folded loop antenna and the second folded loop antenna are folded for forming a three-dimensional structure.

32 Claims, 8 Drawing Sheets

450

460

440

MULTI-LOOP ANTENNA STRUCTURE AND HAND-HELD ELECTRONIC DEVICE USING THE SAME

This application claims the benefit of Taiwan application Serial No. 98113943, filed Apr. 27, 2009, the subject matter of which is incorporated herein by reference.

BACKGROUND OF THE INVENTION

1. Field of the Invention

The subject application relates in general to an antenna and a hand-held electronic device using the same, and more particularly to a multi-loop antenna structure and a hand-held electronic device using the same.

2. Description of the Related Art

Referring to FIG. 1, a generally known loop antenna is shown. The generally known loop antenna 10 includes a feeding point 110, a grounding point 120 and a symmetric radiating body 130. There is a complete loop between the feeding point 110, the grounding point 120 and radiating body 130. That is, the current flowing into the feeding point 110 equals the current flowing out of the grounding point 120, therefore the generally known loop antenna 10 is also called balance antenna. As the generally known loop antenna 10 is big in size and the design of the mobile phone is directed towards slimness, lightweight and compactness, the generally known loop antenna 10 is not widely used in the mobile phone.

Referring to FIG. 2, a generally known open end type antenna is shown. The open end type antenna 20 includes a feeding point 210, a grounding point 220 and a radiating body 230. The loop between the feeding point 210, the grounding point 220 and the radiating body 230 is not a complete loop. The current flowing into the feeding point 210 does not equal the current flowing out of the grounding point 220, therefore the open end type antenna 20 is also called unbalance antenna. As the open end type antenna 20 is small in size, most of the conventional mobile phones adopt the open end type antenna 20 as a medium in wireless communication.

Referring to FIG. 3, a distribution diagram of frequency band of a wireless communication system is shown. Along with the advance in electronic technology, many wireless communication systems, such as the Bluetooth and wireless network (BT/WIFI), the Global System for Mobile Communications (GSM), the Global Positioning System (GPS) and the Digital Communication System (DCS)/the Personal Communication Services (PCS)/the Universal Mobile Telecommunications System (UMTS) are provided. As the frequency bands of these wireless communication system are not the same, if the mobile phone would like to support the abovementioned wireless communication systems, at least three antennas are needed to cover the Bluetooth and wireless network (BT/WIFI) frequency band, the GPS frequency band, the GSM frequency band and the DCS/PCS/UMTS frequency band at the same time.

SUMMARY OF THE INVENTION

The subject application is directed to a multi-loop antenna structure and a mobile communication device using the same which have at least the following advantages:

Firstly, only one multi-loop antenna structure would suffice to cover several frequency bands such as the Bluetooth and wireless network (BT/WIFI) frequency band, the GSM frequency band, the GPS frequency band and the DCS/PCS/UMTS frequency band.

Secondly, the antenna length is only a half of that of generally known loop antenna.

Thirdly, the multi-loop antenna structure can be folded as a three-dimensional structure and disposed on a hand-held device having limited space.

According to a first aspect of the present invention, a multi-loop antenna structure is provided. The multi-loop antenna structure includes a high-frequency radiating body, a low-frequency radiating body, a feeding connecting part and a grounding connecting part. The feeding connecting part electrically connects one terminal of the high-frequency radiating body and one terminal of the low-frequency radiating body to a feeding point. The grounding connecting part grounds the other terminal of the high-frequency radiating body and the other terminal of the low-frequency radiating body. The feeding connecting part forms a first folded loop antenna with the high-frequency radiating body and the grounding connecting part for resonating at a first frequency band. The feeding connecting part forms a second folded loop antenna with the low-frequency radiating body and the grounding connecting part for resonating at a second frequency band, a third frequency band and a fourth frequency band. The first folded loop antenna and the second folded loop antenna are folded for forming a three-dimensional structure.

According to a second aspect of the present invention, a hand-held electronic device is provided. The hand-held electronic device includes a printed circuit board, an antenna carrying part and a multi-loop antenna structure. The antenna carrying part is coupled to the printed circuit board, and the multi-loop antenna structure is disposed on the antenna carrying part. The multi-loop antenna structure includes a high-frequency radiating body, a low-frequency radiating body, a feeding connecting part and a grounding connecting part. The feeding connecting part electrically connects one terminal of the high-frequency radiating body and one terminal of the low-frequency radiating body to a feeding point. The grounding connecting part grounds the other terminal of the high-frequency radiating body and the other terminal of the low-frequency radiating body. The feeding connecting part forms a first folded loop antenna with the high-frequency radiating body and the grounding connecting part for resonating at a first frequency band. The feeding connecting part forms a second folded loop antenna with the low-frequency radiating body and the grounding connecting part for resonating at a second frequency band, a third frequency band and a fourth frequency band. The first folded loop antenna and the second folded loop antenna are folded for forming a three-dimensional structure.

The invention will become apparent from the following detailed description of the preferred but non-limiting embodiments. The following description is made with reference to the accompanying drawings.

DETAILED DESCRIPTION OF THE INVENTION

The subject application provides a multi-loop antenna structure and a hand-held electronic device using the same. The multi-loop antenna structure includes a high-frequency radiating body, a low-frequency radiating body, a feeding connecting part and a grounding connecting part. The feeding connecting part electrically connects one terminal of the high-frequency radiating body and one terminal of the low-frequency radiating body to a feeding point. The grounding connecting part grounds the other terminal of the high-frequency radiating body and the other terminal of the low-frequency radiating body. The feeding connecting part forms a first folded loop antenna with the high-frequency radiating body and the grounding connecting part for resonating at a first frequency band. The feeding connecting part forms a second folded loop antenna with the low-frequency radiating body and the grounding connecting part for resonating at a second frequency band, a third frequency band and a fourth frequency band. The first folded loop antenna and the second folded loop antenna are folded for forming a three-dimensional structure. The hand-held electronic device further includes a printed circuit board and an antenna carrying part in addition to the abovementioned multi-loop antenna structure. The antenna carrying part is coupled to the printed circuit board, and the multi-loop antenna structure is disposed on the antenna carrying part. A first embodiment and a second embodiment are exemplified below.

First Embodiment

Figure 1:
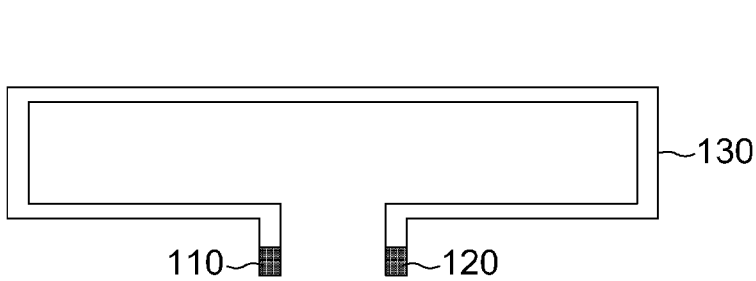
FIG. 1(PRIOR ART)
FIG. 1 (Prior Art) shows a generally known loop antenna.
Figure 2:
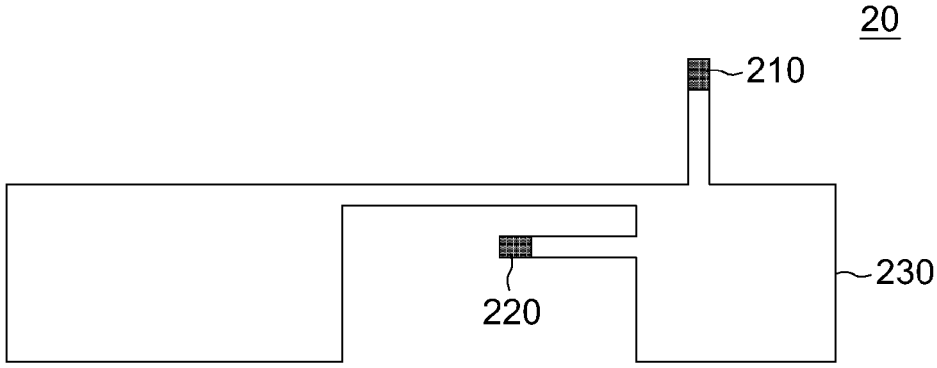
FIG. 2(PRIOR ART)
FIG. 2 (Prior Art) shows a generally known open end type antenna.
Figure 3:
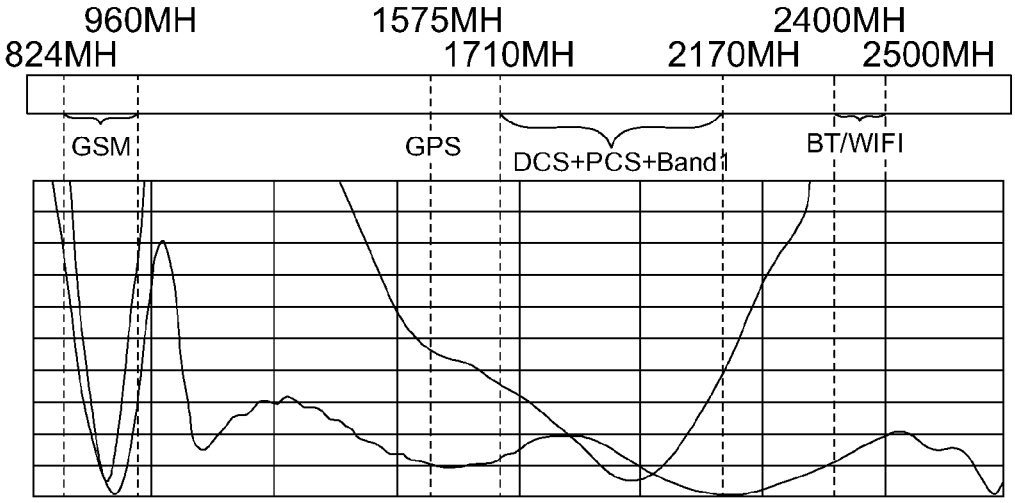
FIG. 3(PRIOR ART)
FIG. 3 shows a distribution diagram of frequency band of a wireless communication system.
Figure 4:
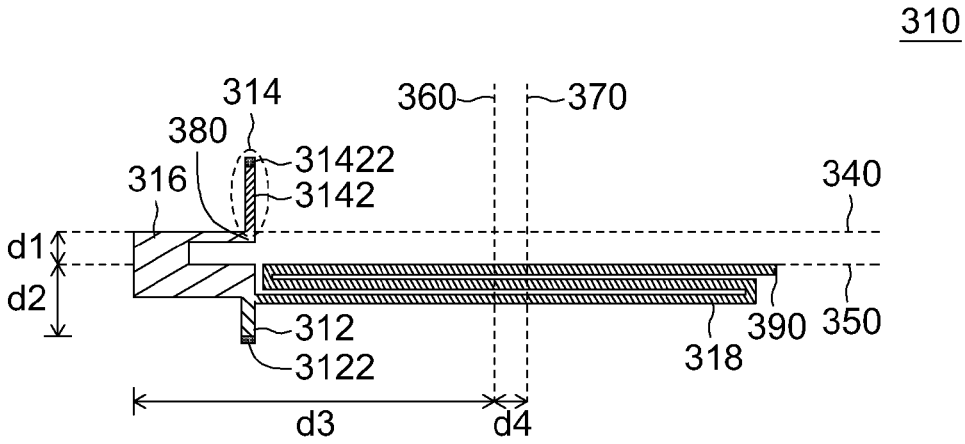
FIG. 4 shows an explosion diagram of a multi-loop antenna structure of a first embodiment of the invention.
Figure 5:
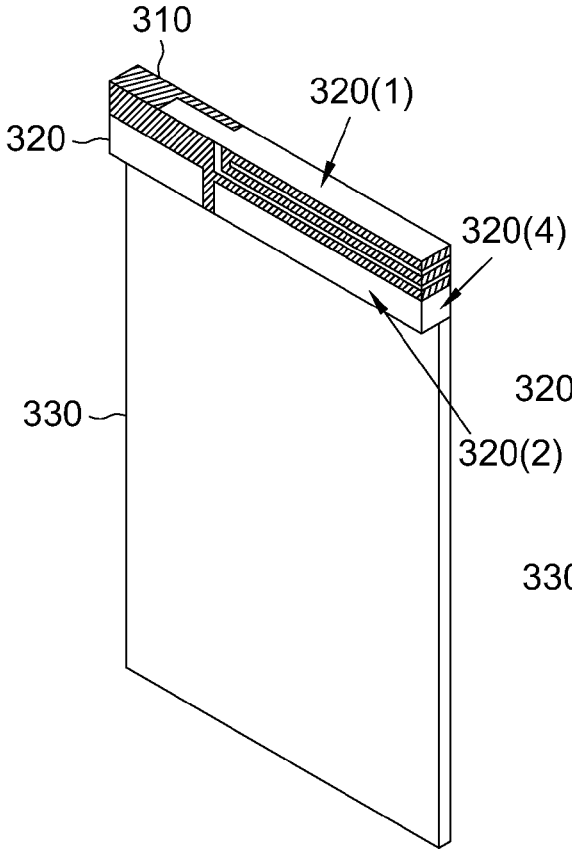
FIG. 5 shows a 3-D diagram of a multi-loop antenna structure of a first embodiment of the invention.
Figure 6:
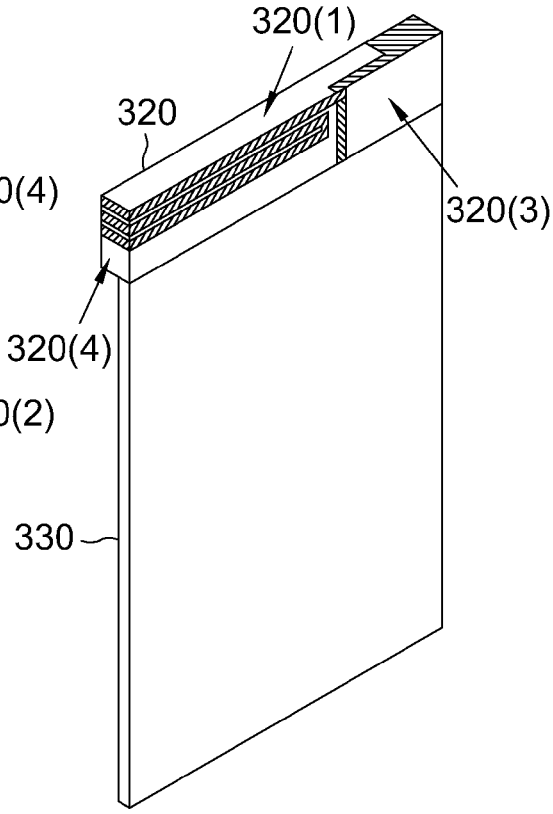
FIG. 6 shows another 3-D diagram of a multi-loop antenna structure of a first embodiment of the invention.

Referring to FIG. 4~FIG. 6. FIG. 4 shows an explosion diagram of a multi-loop antenna structure of a first embodiment of the invention. FIG. 5 and FIG. 6 respectively show a 3-D diagram of a multi-loop antenna structure of a first embodiment of the invention viewed at different angles. The hand-held electronic device 30, such as a mobile phone, a personal digital assistant (PDA) and another communication device, includes a multi-loop antenna structure 310, an antenna carrying part 320 and a printed circuit board 330. The antenna carrying part 320 is coupled to the printed circuit board 330, and the multi-loop antenna structure 310 is disposed on the antenna carrying part 320. The multi-loop antenna structure 310 includes a feeding connecting part 312, a grounding connecting part 314, a similar U-shaped high-frequency radiating body 316 and a similar S-shaped low-frequency radiating body 318. The feeding connecting part 312 electrically connects one terminal of the high-frequency radiating body 316 and one terminal of the low-frequency radiating body 318 to a feeding point 3122. The grounding connecting part 314 grounds the other terminal of the high-frequency radiating body 316 and the other terminal of the low-frequency radiating body 318. The grounding connecting part 314 includes a grounding connecting element 3142, wherein one terminal 380 of the grounding connecting element 3142 connects the other terminal 390 of the high-frequency radiating body 316, the other terminal 390 of the low-frequency radiating body 318, and the other terminal of the grounding connecting element 3142 to a grounding point 31422. The feeding connecting part 312 forms a first folded loop antenna with the high-frequency radiating body 316 and the grounding connecting part 314 for resonating at a first frequency band. The feeding connecting part 312 forms a second folded loop antenna with the low-frequency radiating body 318 and the grounding connecting part 314 for resonating at a second frequency band, a third frequency band and a fourth frequency band. The resonating frequency operating at 0.5 times of the wavelength of the first folded loop antenna generates the first frequency band, and the resonating frequencies operating at 0.5, 1 and 1.5 times of the wavelength of the second folded loop antenna respectively generate the second frequency band, the third frequency band and the fourth frequency band.

The first frequency band is a DCS/PCS/UMTS frequency band ranging from 1710 MHz to 2170 MHz. The second frequency band is a GSM frequency band ranging from 824 MHz to 960 MHz. The third frequency band is a GPS frequency band of 1575 MHz. The fourth frequency band is a Bluetooth and wireless network (BT/WIFI) frequency band ranging from 2400 MHz to 2500 MHz. The first folded loop antenna and the second folded loop antenna are perpendicularly folded along the folding line 340, the folding line 350, the folding line 360 and the folding line 370 for forming a three-dimensional structure. The distances d1 and d4 are 5 mm for example, the distance d2 is 11 mm for example, and the distance d3 is 55 mm for example.

Furthermore, the antenna carrying part 320 includes a surface 320 (1), a surface 320 (2), a surface 320 (3) and a surface 320 (4), wherein the surfaces 320 (1), 320 (2), 320 (3) and 320 (4) are not coplanar to each other. The surface 320 (1) is perpendicular to the surfaces 320 (2), 320 (3) and 320 (4), and the surface 320 (4) is perpendicular to the surfaces 320 (1), 320 (2) and 320 (3). The high-frequency radiating body 316 is perpendicularly folded along the folding line 350, so that a part of the high-frequency radiating body 316 is disposed on the surface 320 (1), and another part of the high-frequency radiating body 316 is disposed on surface 320 (2). The low-frequency radiating body 318 is perpendicularly folded along the folding line 360 and the folding line 370, so that a part of the low-frequency radiating body 318 is disposed on surface 320 (2), another part of the low-frequency radiating body 318 is disposed on surface 320 (4), and yet another part of the low-frequency radiating body 318 is disposed on the surface 320 (3). The feeding connecting part 312 is disposed on the surface 320 (2), and the grounding connecting part 314 is disposed on the surface 320 (3). One terminal 380 of the grounding connecting element 3142 and one terminal 390 of the low-frequency radiating body 318 are coupled to each other on the surface 320 (3).

Figure 7:
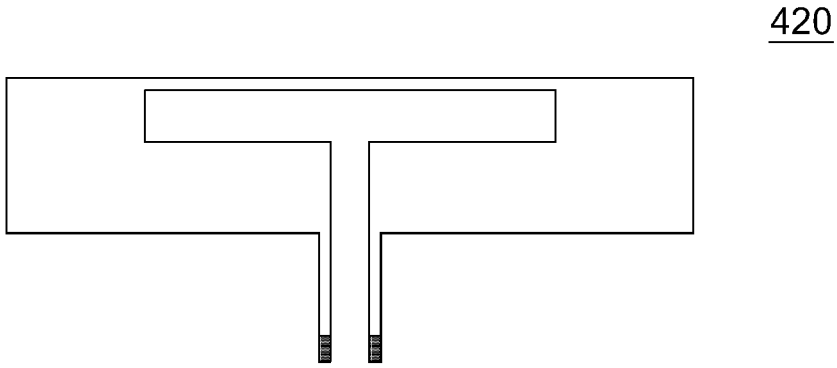
FIG. 7 shows a generally known planar type first balance antenna.
Figure 8:
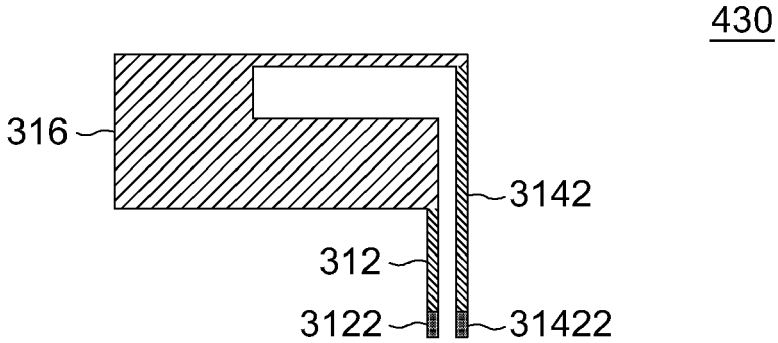
FIG. 8 shows an antenna of FIG. 7 being processed according to image theory for forming a loop antenna of the invention with reduced length.
Figure 9:
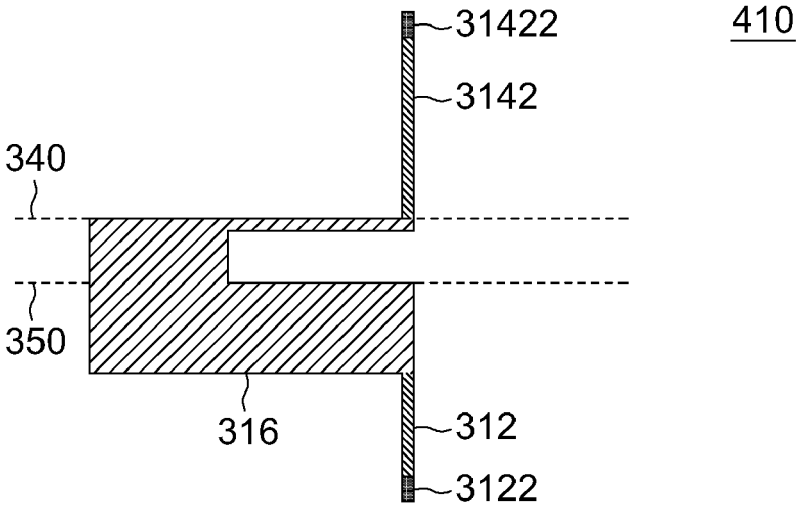
FIG. 9 shows an antenna of FIG. 8 being folded for forming a first folded loop antenna of the invention.

Referring to FIG. 7~FIG. 9. FIG. 7 shows a generally known planar type first balance antenna. FIG. 8 shows an antenna of FIG. 7 being processed according to image theory for forming a loop antenna of the invention with reduced length. FIG. 9 shows an antenna of FIG. 8 being folded for forming a first folded loop antenna of the invention. One terminal of the high-frequency radiating body 316 is electrically connected to a feeding point 3122 through the feeding connecting part 312, and one terminal of the high-frequency radiating body 316 is electrically connected to the grounding point 31422 through the grounding connecting element 3142 of the grounding connecting part 314 for forming the first folded loop antenna 410 of FIG. 9.

The first folded loop antenna 410 corresponds to a generally known planar type first balance antenna 420 of FIG. 7, which is a left-right-symmetric mapping structure. According to the image theory, the generally known planar type first balance antenna 420 is further reduced to the loop antenna 430 of FIG. 8, so that the antenna length (can be viewed as a current path) of the loop antenna 430 is about a half of the generally known planar type first balance antenna 420. The first folded loop antenna 410 of FIG. 9 is formed by folding the grounding connecting element 3142 of the grounding connecting part 314 of the loop antenna 430 and the grounding point 31422 upwards. The first folded loop antenna 410 forms a three-dimensional structure when the first folded loop antenna 410 is perpendicularly folded along the folding line 340 and the folding line 350.

Figure 10:
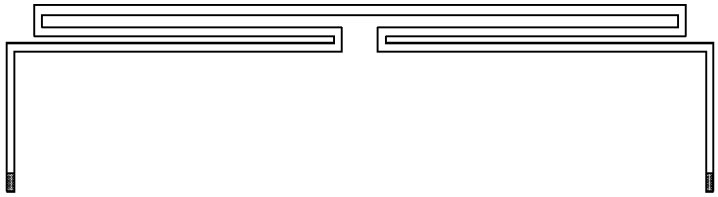
FIG. 10 shows a generally known planar type second balance antenna.
Figure 11:
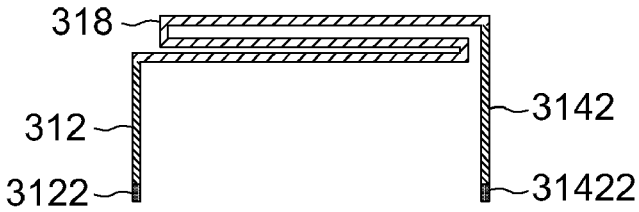
FIG. 11 shows an antenna of FIG. 10 being processed according to image theory for forming a loop antenna of the invention with reduced length.
Figure 12:
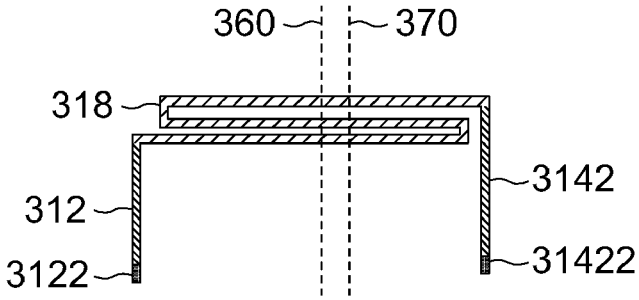
FIG. 12 shows an antenna of FIG. 11 denoting the folding line of a second folded loop antenna of the invention.

Referring to FIG. 10~FIG. 12. FIG. 10 shows a generally known planar type second balance antenna. FIG. 11 shows an antenna of FIG. 10 being processed according to the image theory for forming a loop antenna of the invention with reduced length. FIG. 12 shows an antenna of FIG. 11 denoting the folding line of a second folded loop antenna of the subject application. One terminal of the low-frequency radiating body 318 is electrically connected to the feeding point 3122 through the feeding connecting part 312, and one terminal of the low-frequency radiating body 318 is electrically connected to t the grounding point 31422 through the grounding connecting element 3142 of the grounding connecting part 314 for forming the second folded loop antenna 440 of FIG. 12.

The second folded loop antenna 440 corresponds to the generally known planar type second balance antenna 450 of FIG. 10, which is a left-right-symmetric mapping structure. According to the image theory, the second balance antenna 450 is further reduced to the loop antenna 460 of FIG. 11, so that the antenna length (can be viewed as a current path) of the loop antenna 460 is about a half of the second balance antenna 450. The second folded loop antenna 440 of FIG. 12 is formed by folding the grounding connecting element 3142 of the grounding connecting part 314 of the loop antenna 460 and the grounding point 31422 rightwards. The second folded loop antenna 440 forms a three-dimensional structure when the second folded loop antenna 440 is perpendicularly folded along the folding line 360 and the folding line 370.

Due to the limited space of the portable electronic device and the big size of the loop antenna, the loop antenna was not commonly used in the hand-held electronic device, and the open end type antenna such as the planar inverted-F antenna (PIFA) was used instead. According to the image theory, the subject application preferably reduces the length of the loop antenna to be half of its original length, and the reduced loop antenna is further folded as a three-dimensional structure, so that the loop antenna can be disposed on the hand-held device having limited space. As the loop antenna can resonate at the operating frequency of 0.5, 1 and 1.5 times of the wavelength, the subject application can resonate at several frequency bands by using one multi-loop antenna structure only.

Figure 13:
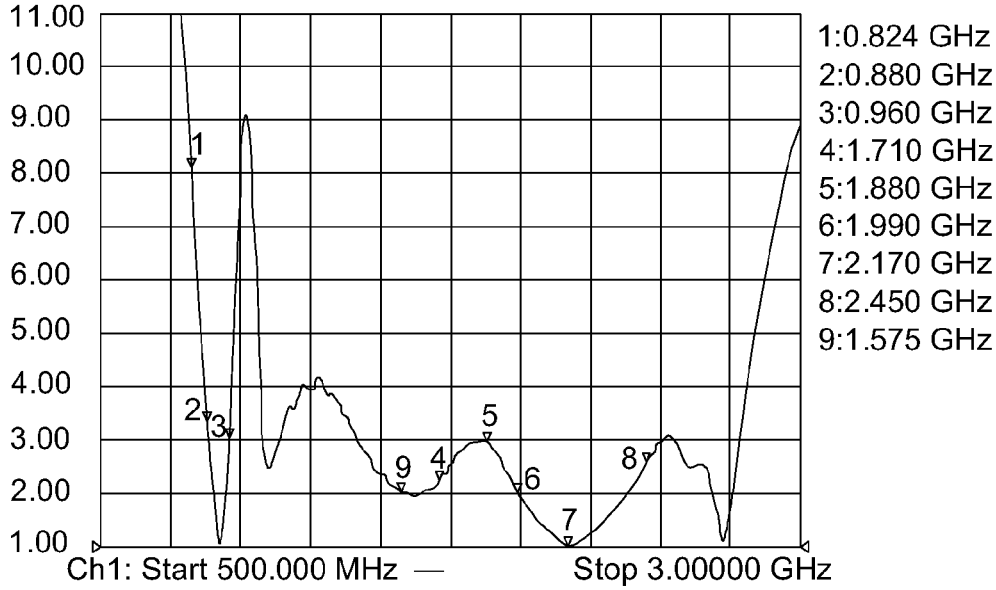
FIG. 13 shows a voltage standing wave ratio (VSWR) diagram of a multi-loop antenna structure 310 of the invention.
Figure 14:
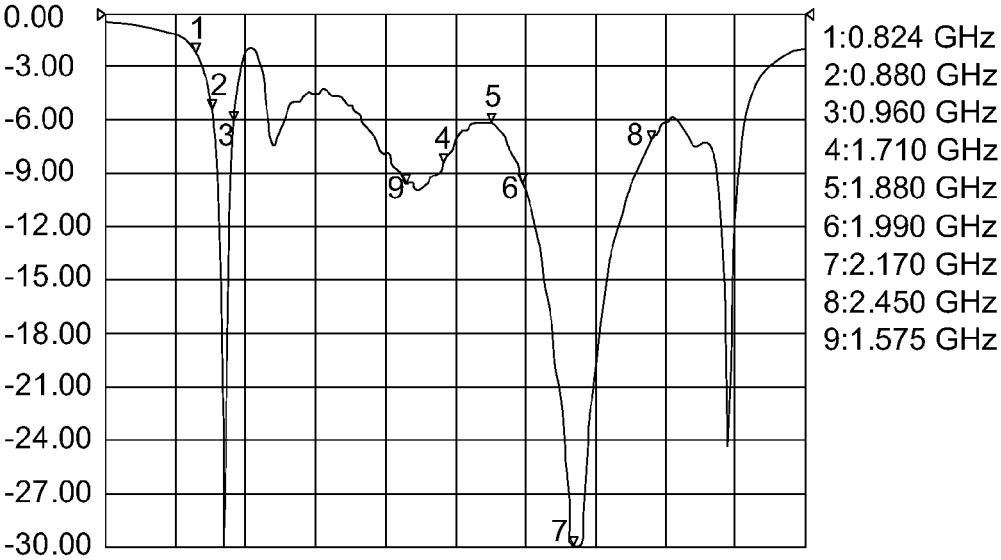
FIG. 14 shows a return-loss diagram of a multi-loop antenna structure 310 of the invention.
Figure 15:
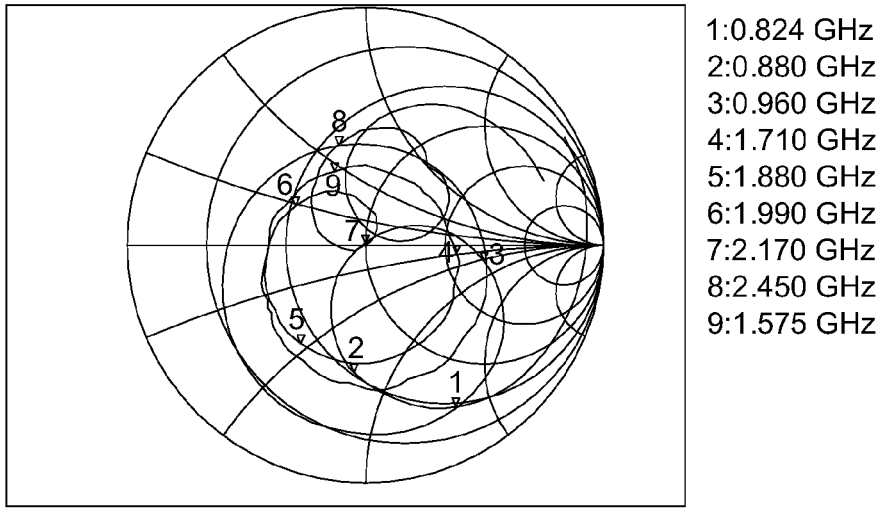
FIG. 15 shows a Smith chart of a multi-loop antenna structure 310 of the invention.

Referring to FIG. 13~FIG. 15. FIG. 13 shows a voltage standing wave ratio (VSWR) diagram of a multi-loop antenna structure 310 of the invention. FIG. 14 shows a return-loss diagram of a multi-loop antenna structure 310 of the invention. FIG. 15 shows a Smith chart of a multi-loop antenna structure 310 of the invention. The antenna effect of the multi-loop antenna structure 310 and the feature of resonating at a Bluetooth and wireless network (BT/WIFI) frequency band, a GSM frequency band, a GPS frequency band and a DCS/PCS/UMTS frequency band are indicated in FIG. 13~FIG. 15.

Second Embodiment

Figure 16:
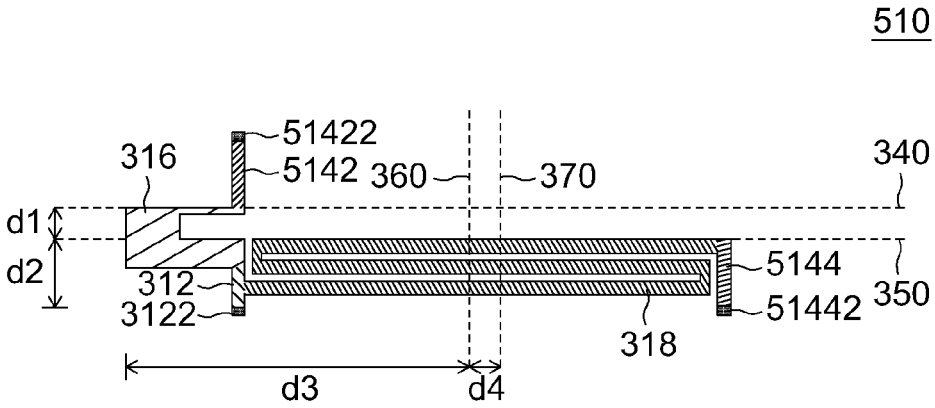
FIG. 16 shows an explosion diagram of a multi-loop antenna structure of a second embodiment of the invention.
Figure 17:
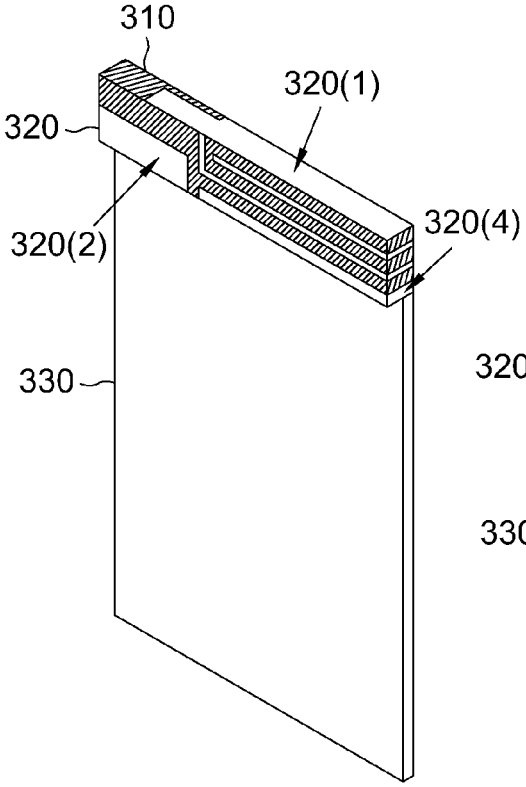
FIG. 17 shows a 3-D diagram of a multi-loop antenna structure of a second embodiment of the invention.
Figure 18:
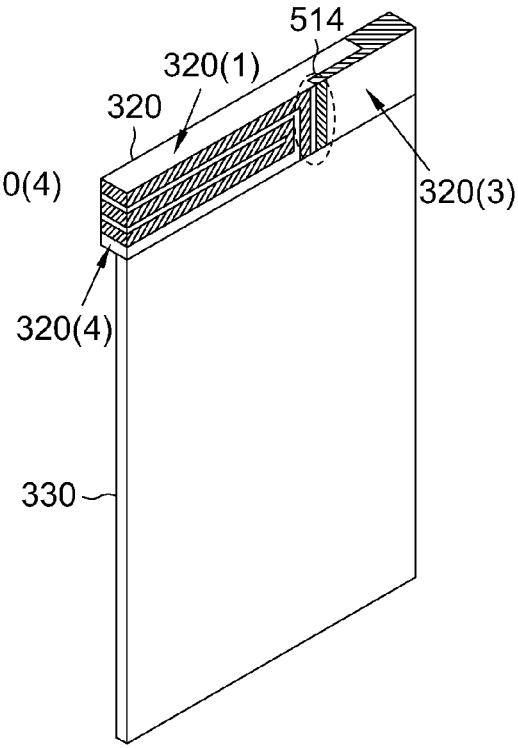
FIG. 18 shows a 3-D diagram of a multi-loop antenna structure of a second embodiment of the invention.

Referring to FIG. 16~FIG. 18. FIG. 16 shows an explosion diagram of a multi-loop antenna structure of a second embodiment of the invention. FIG. 17 shows a 3-D diagram of a multi-loop antenna structure of a second embodiment of the invention. FIG. 18 shows a 3-D diagram of a multi-loop antenna structure of a second embodiment of the invention. The second embodiment differs with the first embodiment in that the high-frequency radiating body 316 and the low-frequency radiating body 318 of the multi-loop antenna structure 510 respectively have the grounding connecting elements 5142 and 5144, but the grounding connecting element 3142 is shared by the high-frequency radiating body 316 and the low-frequency radiating body 318 of the multi-loop antenna structure 310. In the present embodiment of the invention, the grounding connecting part 514 includes a grounding connecting element 5142 of the high-frequency radiating body 316 and a grounding connecting element 5144 of the low-frequency radiating body 318. One terminal of the grounding connecting element 5142 is connected to the other terminal of the high-frequency radiating body 316, and the other terminal of the grounding connecting element 5142 is connected to the grounding point 51422. One terminal of the grounding connecting element 5144 is connected to the other terminal of the low-frequency radiating body 318, and the other terminal of the grounding connecting element 5142 is connected to the grounding point 51442. That is, the other terminal of the high-frequency radiating body 316 and the other terminal of the low-frequency radiating body 318 are respectively connected to the grounding point 51422 and the grounding point 51442 through the grounding connecting element 5142 and the grounding connecting element 5144. Thus, the bandwidth of the high-frequency frequency band is further increased. Referring to the bandwidth as disclosed in the high-frequency frequency band of FIG. 14 and FIG. 20, the commonly used index is −8 db. With such criterion being given, the bandwidth of the high-frequency band of FIG. 14 (the high-frequency radiating body and the low-frequency radiating body share the grounding connecting part 314) is smaller than the ones of the high-frequency band of FIG. 20 (the high-frequency radiating body and the low-frequency radiating body have their respective grounding connecting part 514).

Figure 19:
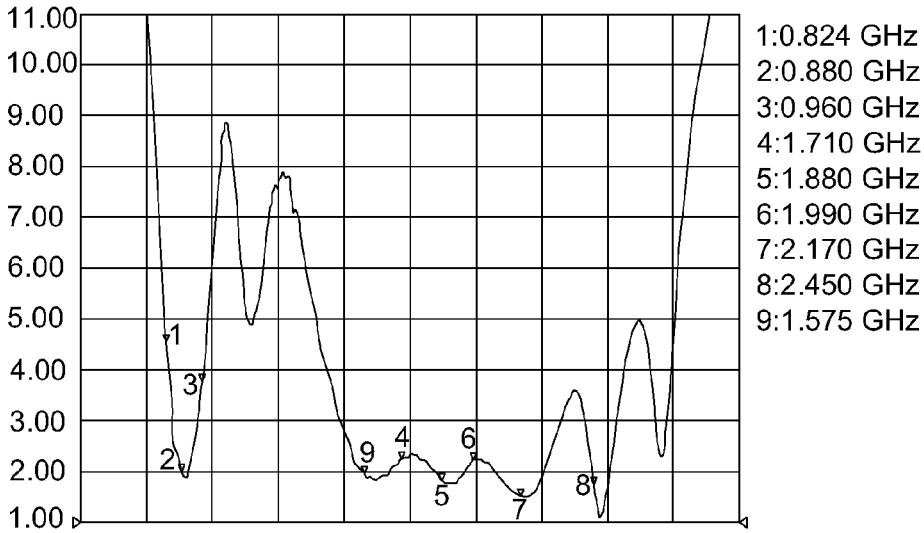
FIG. 19 shows a voltage standing wave ratio (VSWR) diagram of a multi-loop antenna structure 510 of the invention.
Figure 20:
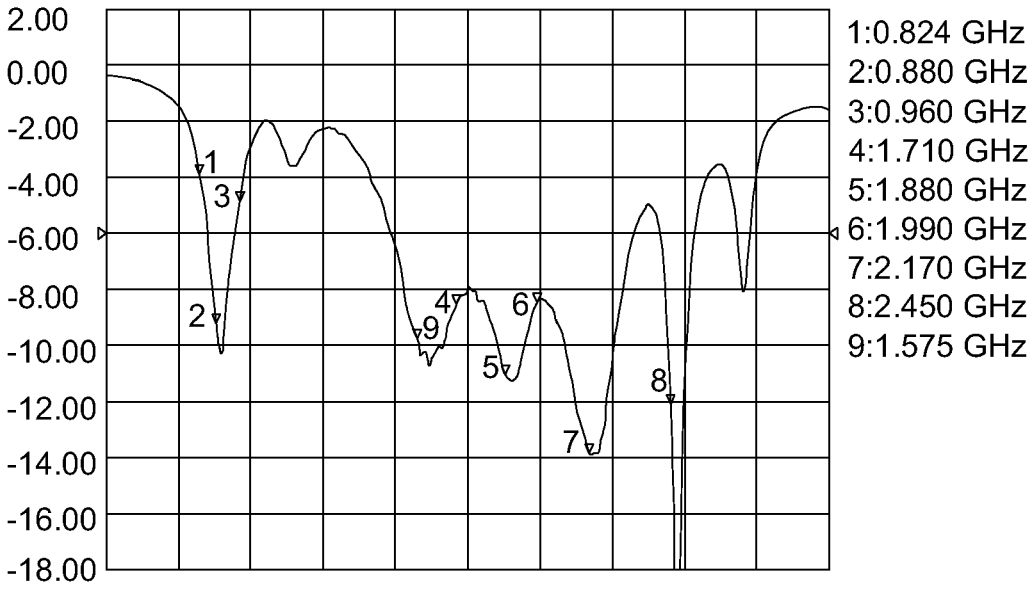
FIG. 20 shows a return-loss diagram of a multi-loop antenna structure 510 of the invention.
Figure 21:
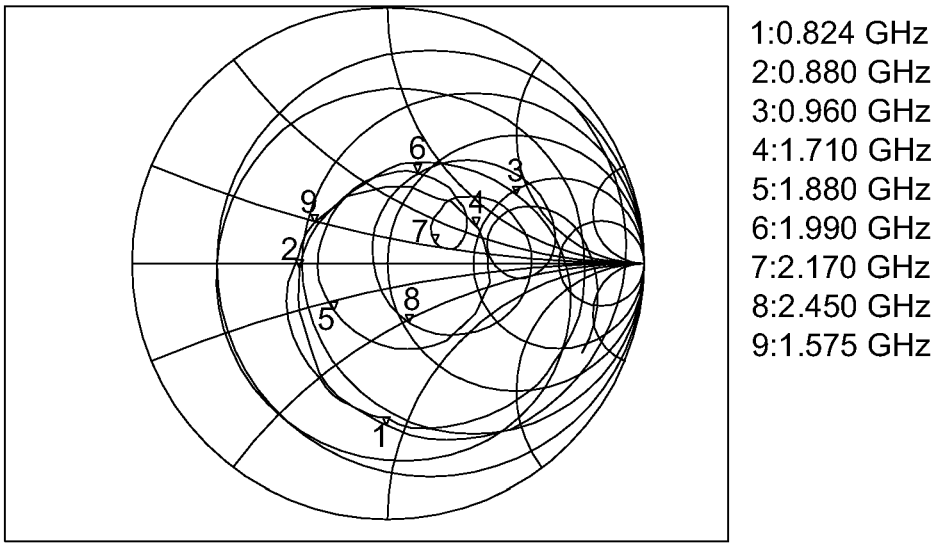
FIG. 21 shows a Smith chart of a multi-loop antenna structure 510 of the invention.

Referring to FIG. 19~FIG. 21. FIG. 19 shows a voltage standing wave ratio (VSWR) diagram of a multi-loop antenna structure 510 of the subject application. FIG. 20 shows a return-loss diagram of a multi-loop antenna structure 510 of the subject application. FIG. 21 shows a Smith chart of a multi-loop antenna structure 510 of the subject application. The antenna effect of the multi-loop antenna structure 510 and the feature of resonating at a Bluetooth and wireless network (BT/WIFI) frequency band, a GSM frequency band, a GPS frequency band and a DCS/PCS/UMTS frequency band are indicated in FIG. 19~FIG. 21.

The multi-loop antenna structure and the hand-held electronic device using the same disclosed in the above embodiments of the invention have many advantages exemplified below:

Firstly, only one multi-loop antenna structure would suffice to cover several frequency bands such as the Bluetooth and wireless network (BT/WIFI) frequency band, the GSM frequency band, the GPS frequency band and the DCS/PCS/UMTS frequency band.

Secondly, the antenna length is only a half of that of generally known loop antenna.

Thirdly, the multi-loop antenna structure can be folded as a three-dimensional structure and disposed on a hand-held device having limited space.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-loop antenna structure, comprising:

a high-frequency radiating body;

a low-frequency radiating body;

a feeding connecting part used for electrically connecting one terminal of the high-frequency radiating body and one terminal of the low-frequency radiating body to a feeding point; and a grounding connecting part used for grounding the other terminal of the high-frequency radiating body and the other terminal of the low-frequency radiating body, wherein the feeding connecting part forms a first folded loop antenna with the high-frequency radiating body and the grounding connecting part for resonating at a first frequency band, the feeding connecting part forms a second folded loop antenna with the low-frequency radiating body and the grounding connecting part for resonating at a second frequency band, a third frequency band and a fourth frequency band, and the first folded loop antenna and the second folded loop antenna are folded for forming a three-dimensional structure.

2. The multi-loop antenna structure according to claim 1, wherein the high-frequency radiating body is a U-shaped structure, and the low-frequency radiating body is an S-shaped structure.

3. The multi-loop antenna structure according to claim 1, wherein the grounding connecting part comprises:

a grounding connecting element, comprising:

a first terminal connected to the other terminal of the high-frequency radiating body and the other terminal of the low-frequency radiating body; and a second terminal connected to a grounding point.

4. The multi-loop antenna structure according to claim 1, wherein the grounding connecting part comprises:

a first grounding connecting element, comprising:

a first terminal connected to the other terminal of the high-frequency radiating body; and a second terminal connected to a grounding point; and a second the grounding connecting element, comprising:

a third terminal connected to the other terminal of the low-frequency radiating body; and a fourth terminal connected to another grounding point.

5. The multi-loop antenna structure according to claim 1, wherein the high-frequency radiating body is folded and disposed on a plurality of non-coplanar planes.

6. The multi-loop antenna structure according to claim 1, wherein the low-frequency radiating body is folded and disposed on a plurality of non-coplanar planes.

7. The multi-loop antenna structure according to claim 1, wherein the feeding connecting part, the grounding connecting part, the high-frequency radiating body and the low-frequency radiating body are disposed on a first surface, a second surface, a third surface and a fourth surface of an antenna carrying part, the first surface is perpendicular to the second surface, the third surface and the fourth surface, and the fourth surface is perpendicular to the first surface, the second surface and the third surface.

8. The multi-loop antenna structure according to claim 7, wherein the multi-loop antenna structure, wherein the high-frequency radiating body comprises:

a first part disposed on the first surface; and a second part disposed on the second surface.

9. The multi-loop antenna structure according to claim 8, wherein the low-frequency radiating body comprises:

a first part disposed on the second surface;

a second part disposed on the fourth surface; and a third part disposed on the third surface.

10. The multi-loop antenna structure according to claim 9, wherein the feeding connecting part is disposed on the second surface, and the grounding connecting part is disposed on the third surface.

11. The multi-loop antenna structure according to claim 1, wherein the first folded loop antenna corresponds to a first balance antenna, and the current path of the first folded loop antenna is a half of the length of the first balance antenna.

12. The multi-loop antenna structure according to claim 1, wherein the second folded loop antenna corresponds to a second balance antenna, and the current path of the second folded loop antenna is a half of the length of the second balance antenna.

13. The multi-loop antenna structure according to claim 1, wherein the current path of the first folded loop antenna is a half of the wavelength.

14. The multi-loop antenna structure according to claim 1, wherein the current path of the second folded loop antenna is a half of the wavelength.

15. The multi-loop antenna structure according to claim 1, wherein the first frequency band is a DCS/PCS/UMTS frequency band, the second frequency band is a GSM frequency band, the third frequency band is a GPS frequency band, and the fourth frequency band is a Bluetooth and wireless network frequency band.

16. The multi-loop antenna structure according to claim 15, wherein the Bluetooth and the wireless network frequency band substantially range from 2400 MHz to 2500 MHz, the GSM frequency band substantially ranges from 824 MHz to 960 MHz, the GPS frequency band substantially ranges from 1575 MHz, the DCS/PCS/UMTS band1 substantially ranges from 1710 MHz to 2170 MHz.

17. A hand-held electronic device, comprising:

a printed circuit board;

an antenna carrying part coupled to the printed circuit board;

a multi-loop antenna structure disposed on the antenna carrying part, wherein the multi-loop antenna structure comprises:

a high-frequency radiating body;

a low-frequency radiating body;

a feeding connecting part used for electrically connecting one terminal of the high-frequency radiating body and one terminal of the low-frequency radiating body to a feeding point; and a grounding connecting part used for grounding the other terminal of the high-frequency radiating body and the other terminal of the low-frequency radiating body, the feeding connecting part forms a first folded loop antenna with the high-frequency radiating body and the grounding connecting part for resonating at a first frequency band, the feeding connecting part forms a second folded loop antenna with the low-frequency radiating body and the grounding connecting part for resonating at a second frequency band, a third frequency band and a fourth frequency band, and the first folded loop antenna and the second folded loop antenna are folded for forming a three-dimensional structure.

18. The hand-held electronic device according to claim 17, wherein the high-frequency radiating body is a U-shaped structure, and the low-frequency radiating body is an S-shaped structure.

19. The hand-held electronic device according to claim 17, wherein the grounding connecting part comprises:

a grounding connecting element, comprising:

a first terminal connected to the other terminal of the high-frequency radiating body and the other terminal of the low-frequency radiating body; and a second terminal connected to a grounding point.

20. The hand-held electronic device according to claim 17, wherein the grounding connecting part comprises:

a first grounding connecting element, comprising:

a first terminal connected to the other terminal of the high-frequency radiating body; and a second terminal connected to a grounding point; and a second the grounding connecting element, comprising:

a third terminal connected to the other terminal of the low-frequency radiating body; and a fourth terminal connected to another grounding point.

21. The hand-held electronic device according to claim 17, wherein the high-frequency radiating body is folded and disposed on a plurality of non-coplanar planes.

22. The hand-held electronic device according to claim 17, wherein the low-frequency radiating body is folded and disposed on a plurality of non-coplanar planes.

23. The hand-held electronic device according to claim 17, wherein the feeding connecting part, the grounding connecting part, the high-frequency radiating body and the low-frequency radiating body are disposed on a first surface, a second surface, a third surface and a fourth surface of an antenna carrying part, the first surface is perpendicular to the second surface, the third surface and the fourth surface, and the fourth surface is perpendicular to the first surface, the second surface and the third surface.

24. The hand-held electronic device according to claim 23, wherein the high-frequency radiating body comprises:

a first part disposed on the first surface; and a second part disposed on the second surface.

25. The hand-held electronic device according to claim 24, wherein the low-frequency radiating body comprises:

a first part disposed on the second surface;

a second part disposed on the fourth surface; and a third part disposed on the third surface.

26. The hand-held electronic device according to claim 25, wherein the feeding connecting part is disposed on the second surface, and the grounding connecting part is disposed on the third surface.

27. The hand-held electronic device according to claim 17, wherein the first folded loop antenna corresponds to a first balance antenna, and the current path of the first folded loop antenna is a half of the length of the first balance antenna.

28. The hand-held electronic device according to claim 17, wherein the second folded loop antenna corresponds to a second balance antenna, and the current path of the second folded loop antenna is a half of the length of the second balance antenna.

29. The hand-held electronic device according to claim 17, wherein the current path of the first folded loop antenna is a half of the wavelength.

30. The hand-held electronic device according to claim 17, wherein the current path of the second folded loop antenna is a half of the wavelength.

31. The hand-held electronic device according to claim 17, wherein the first frequency band is a DCS/PCS/UMTS frequency band, the second frequency band is a GSM frequency band, the third frequency band is a GPS frequency band, and the fourth frequency band is a Bluetooth and wireless network frequency band.

32. The hand-held electronic device according to claim 31, wherein the Bluetooth and the wireless network frequency band substantially range from 2400 MHz to 2500 MHz, the GSM frequency band substantially ranges from 824 MHz to 960 MHz, the GPS frequency band substantially ranges from 1575 MHz, and the DCS/PCS/UMTS band1 substantially ranges from 1710 MHz to 2170 MHz.

* * * * *